US006227114B1

(12) United States Patent
Wu et al.

(10) Patent No.: US 6,227,114 B1
(45) Date of Patent: May 8, 2001

(54) SELECT TRIGGER AND DETONATION SYSTEM USING AN OPTICAL FIBER

(75) Inventors: Jian-Qun Wu, Houston, TX (US); Alan D. Kersey, South Glastonbury, CT (US); Arthur D. Hay, Cheshire, CT (US); James R. Dunphy, South Glastonbury, CT (US)

(73) Assignee: CiDRA Corporation, Wallingford, CT (US)

( * ) Notice: Subject to any disclaimer, the term of this patent is extended or adjusted under 35 U.S.C. 154(b) by 0 days.

(21) Appl. No.: 09/222,637

(22) Filed: Dec. 29, 1998

(51) Int. Cl.[7] ..... F42D 1/04; F42D 1/05

(52) U.S. Cl. ..... 102/201; 102/201; 102/200; 102/213

(58) Field of Search ..... 102/201, 213, 102/200

(56) References Cited

U.S. PATENT DOCUMENTS

| | | | | |
|---|---|---|---|---|
| 2,301,326 | | 11/1942 | Reistle, Jr. . | |
| 2,824,378 | | 2/1958 | Stokes . | |
| 2,894,200 | | 7/1959 | Szasz . | |
| 3,086,167 | | 4/1963 | Chaney et al. . | |
| 4,162,400 | | 7/1979 | Pitts, Jr. . | |
| 4,167,111 | | 9/1979 | Spuck, III . | |
| 4,226,288 | | 10/1980 | Collins, Jr. . | |
| 4,389,645 | | 6/1983 | Wharton . | |
| 4,391,195 | | 7/1983 | Shann . | |
| 4,442,842 | | 4/1984 | Baba . | |
| 4,455,869 | | 6/1984 | Broussard et al. . | |
| 4,594,691 | | 6/1986 | Kimball et al. . | |
| 4,610,006 | | 9/1986 | MacDonald . | |
| 4,700,803 | | 10/1987 | Mallett et al. . | |
| 4,703,460 | | 10/1987 | Kurkjian et al. . | |
| 4,852,067 | | 7/1989 | White . | |
| 4,917,014 | * | 4/1990 | Loughry et al. | 102/201 |
| 4,950,883 | | 8/1990 | Glenn . | |
| 4,951,267 | | 8/1990 | Chang et al. . | |
| 4,951,677 | | 8/1990 | Crowley et al. . | |
| 4,996,419 | | 2/1991 | Morey . | |
| 5,007,705 | | 4/1991 | Morey et al. . | |
| 5,097,838 | | 3/1992 | Hirooka et al. . | |
| 5,142,984 | * | 9/1992 | Stearns et al. | 102/213 |
| 5,142,985 | * | 9/1992 | Stearns et al. | 102/213 |
| 5,206,455 | * | 4/1993 | Williams et al. | 102/201 |
| 5,467,212 | | 11/1995 | Huber . | |
| 5,495,547 | | 2/1996 | Rafie et al. . | |

(List continued on next page.)

*Primary Examiner*—Michael J. Carone
*Assistant Examiner*—Lulit Semunegus
(74) *Attorney, Agent, or Firm*—Ware, Fressola, Van Der Sluys & Adolphson LLP

(57) ABSTRACT

The invention provides a select trigger or detonation system featuring an optical source, an optical fiber, one or more optical couplers and one or more light trigger or detonation devices. The an optical source provides an optical signal containing information about triggering or detonating a respective device. The optical fiber has one or more fiber Bragg Gratings for providing one or more fiber Bragg Grating optical trigger or detonation signals, each having a respective optical trigger or detonation wavelength. The one or more optical couplers each respond to the one or more fiber Bragg Grating optical trigger or detonation signals depending on the respective optical trigger or detonation wavelength, for providing a respective coupled fiber Bragg Grating optical trigger or detonation signal. The one or more light trigger or detonation devices each respond to the respective coupled fiber Bragg Grating optical trigger or detonation signals, for triggering or detonating the respective device, which may detonating an explosive charge or triggering any other control device to be actuated. In one embodiment, the one or more optical couplers may include a circulation coupler or a directional coupler. The system may also be used as a monitoring system.

23 Claims, 6 Drawing Sheets

U.S. PATENT DOCUMENTS

| | | | | |
|---|---|---|---|---|
| 5,510,582 | | 4/1996 | Birchak et al. . | |
| 5,525,970 | * | 6/1996 | Friedman et al. | 340/635 |
| 5,623,455 | | 4/1997 | Norris . | |
| 5,626,192 | | 5/1997 | Connell et al. . | |
| 5,675,674 | | 10/1997 | Weis . | |
| 5,731,550 | | 3/1998 | Lester et al. . | |
| 5,737,278 | | 4/1998 | Frederick et al. . | |
| 5,804,713 | | 9/1998 | Kluth . | |
| 5,808,779 | | 9/1998 | Weis . | |
| 6,049,727 | * | 4/2000 | Crothall | 600/310 |
| 6,072,567 | * | 6/2000 | Sapack | 356/32 |

* cited by examiner

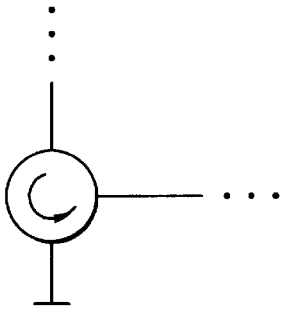
FIG.2 (NON REFLECTIVE TERMINATION)
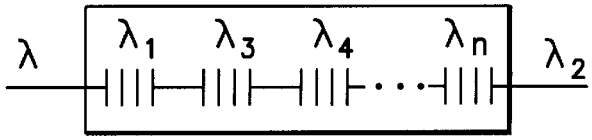
FIG.3A (PASSBAND FILTER)
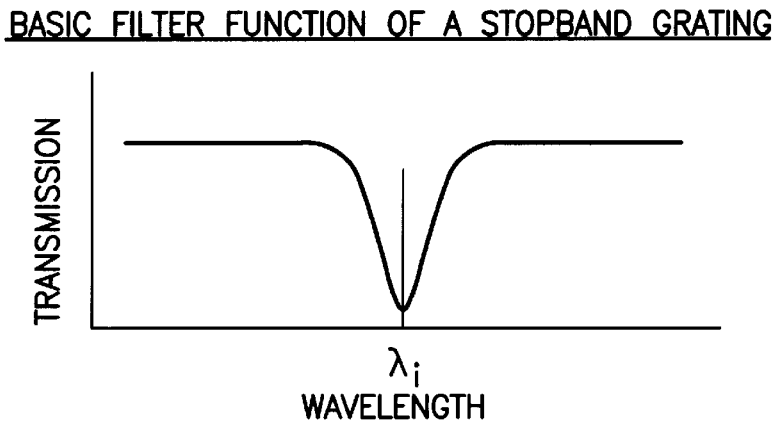
FIG.3B
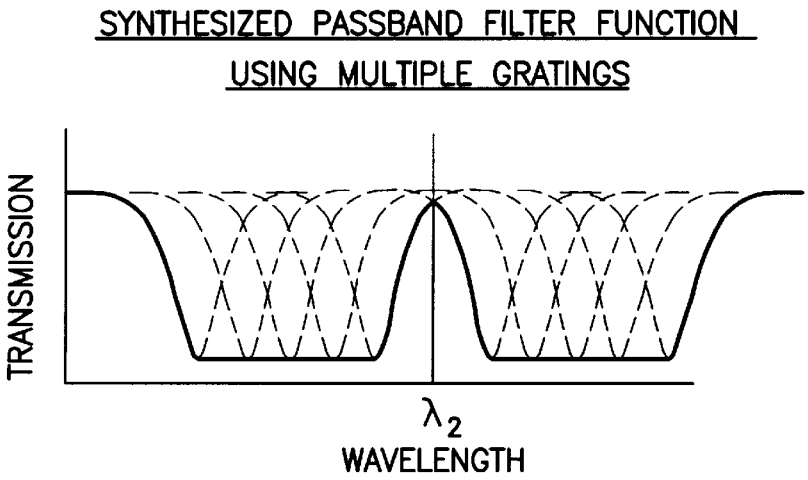
FIG.3C

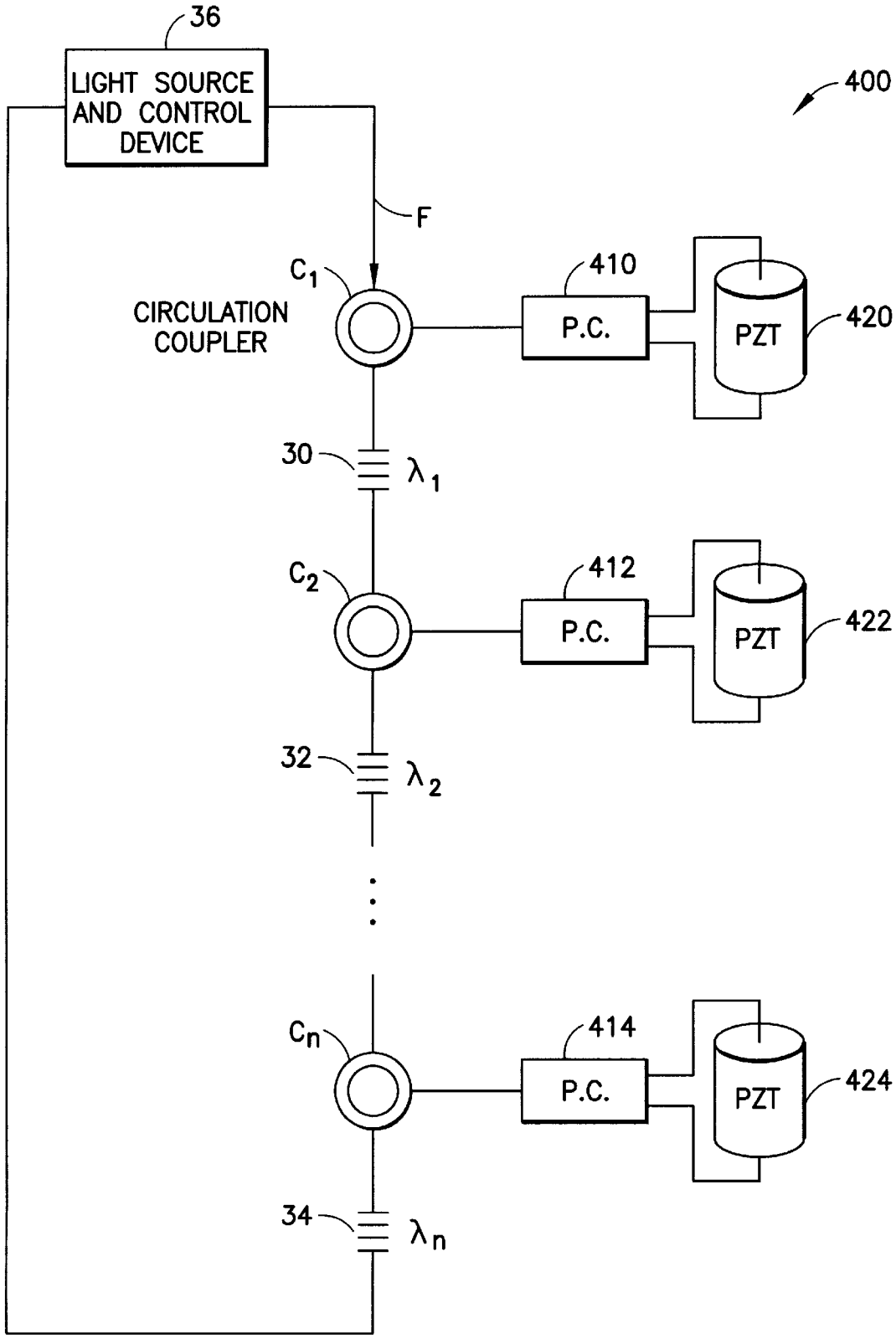
FIG.8 MULTIPLE ACOUSTIC SOURCES ON A SINGLE FIBER

SELECT TRIGGER AND DETONATION SYSTEM USING AN OPTICAL FIBER

BACKGROUND OF INVENTION

1. Technical Field

The present invention relates to a trigger, detonation or monitoring system using optical fiber; and more particularly, to a detonation system of explosive charges in an oil well or to triggering a control device that needs to be actuated.

2. Description of the Prior Art

Trigger or detonation systems, including systems using optical fiber for detonating explosive charges in an oil well, are known in the art. For example, U.S. Pat. No. 4,391,195 shows and describes a detonation system of explosives charges having a laser source, a distributor, a control unit, optical fibers, branching connections and explosive charges. The distributor operates by mechanical actuation for directing light from the laser source through the optical branches for igniting one or more of the explosive charges. One disadvantage of this detonation system is that the distributor distributes optical signals mechanically.

SUMMARY OF THE INVENTION

The invention provides a select trigger or detonation system featuring an optical source, an optical fiber, one or more optical couplers and one or more light trigger or detonation devices.

The optical source provides an optical signal containing information about triggering or detonating one or more respective devices.

The optical fiber has one or more fiber Bragg Gratings, responsive to the optical signal, for providing one or more fiber Bragg Grating optical trigger or detonation signals, each having a respective optical trigger or detonation wavelength.

The one or more optical couplers each respond to the one or more fiber Bragg Grating optical trigger or detonation signals depending on the respective optical trigger or detonation wavelength, for providing a respective coupled fiber Bragg Grating optical trigger or detonation signal. The one or more optical couplers may include a circulation coupler or a directional coupler.

The one or more light trigger or detonation devices each respond to the respective coupled fiber Bragg Grating optical trigger or detonation signal, for triggering or detonating a respective device. The respective device may include an explosive charge to be detonated or any other control device to be triggered from one state to another such as from "on" to "off", or vice versa. For example, the light trigger or detonation device may respond to the respective coupled fiber Bragg Grating optical trigger or detonation signals, for exploding dynamite disposed in a borehole of an oil well. The light trigger or detonation device may also include a photodetector with the necessary supporting documentation attached on an end of the optical fiber for directly detonating an explosive, or include a flashing compound, having nitro or nitroso-resorcinol, placed on an end of the optical fiber.

The select trigger or detonation system may also include a fiber Bragg Grating having very low reflectivity placed next to each explosive charge for providing information to monitor whether it has been detonated and blown up.

The select trigger or detonation system may also include a passband filter in front of each light trigger or detonation device to prevent accidental detonation for example of an explosive charge or the triggering of a device. The passband filter may be a coupler-based or Grating-based passband filter or other passband component.

The select trigger or detonation system may also have separate fibers connected directly to a device for delivering optical trigger or detonation signals to the device to be triggered or detonated, including an explosive charge. The select trigger or detonation system may include one or more multimode fibers for providing one or more multimode optical trigger or detonation signals to deliver energy to one or more optically detonated devices, as well as one or more single mode fibers for providing one or more single mode optical monitoring signals to monitor the one or more optically detonated devices.

One advantage of the present invention is that the one or more optical trigger or detonation signals are optically delivered to the device to be detonated or triggered without any moving mechanical parts.

Other features and advantages of the present invention will be described below.

BRIEF DESCRIPTION OF THE DRAWING

FIG. 2 is a schematic diagram of a circulation coupler having a nonreflective termination.

FIG. 3A is a schematic diagram of a fiber Bragg Grating passband filter.

FIG. 3B shows a graph of a basic filter function of a stopband grating.

FIG. 3C shows a graph of a synthesized passband filter function using multiple gratings as shown in FIG. 3A.

FIG. 8 is a schematic diagram of still another embodiment of the present invention having multiple acoustic sources on a single fiber.

DETAILED DESCRIPTION OF THE INVENTION

Figure 1:
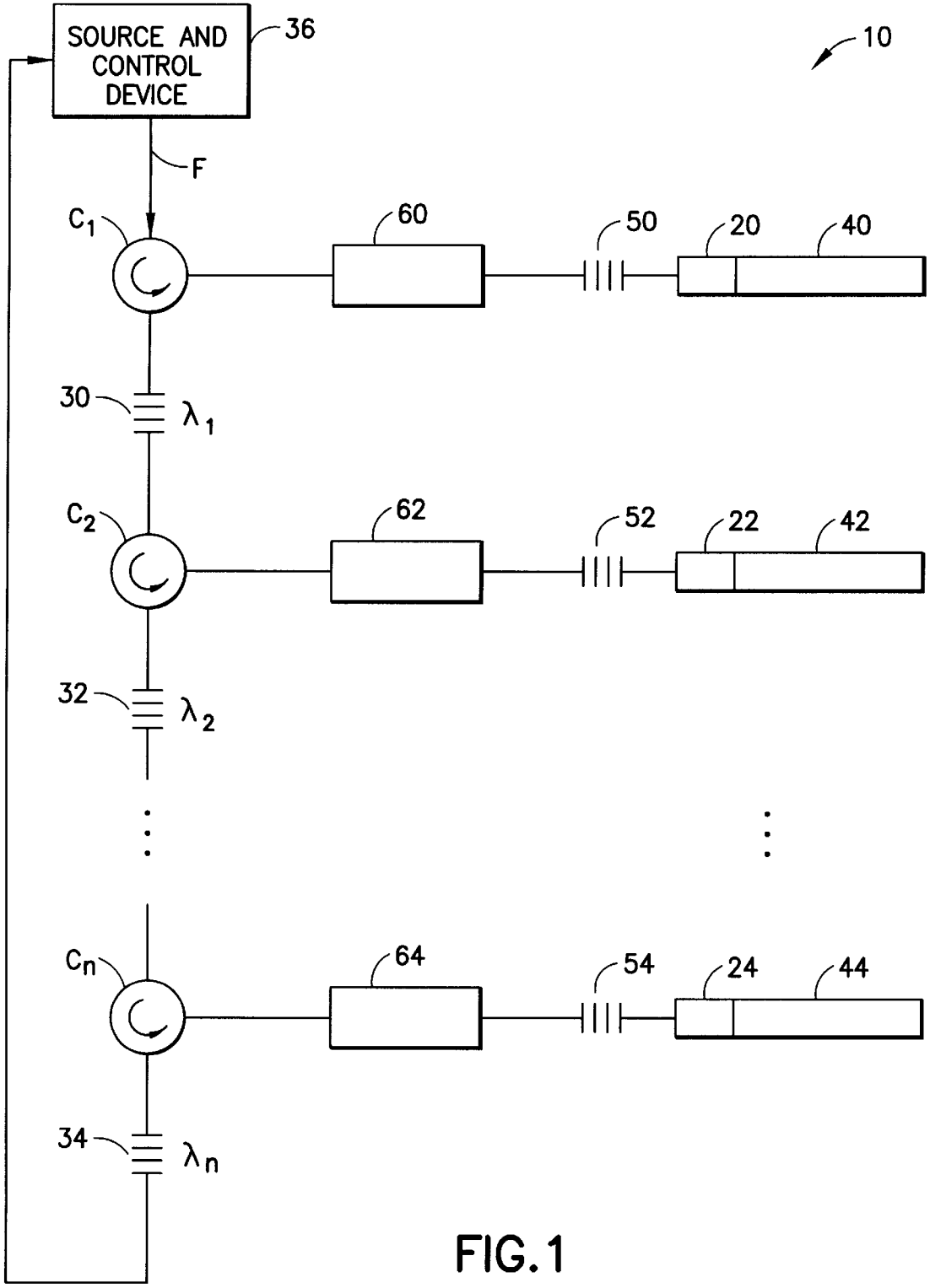
FIG. 1 is a schematic diagram of a select trigger system that is the subject matter of the present invention.

FIG. 1 shows a select trigger or detonation system using fiber optics generally indicated as 10. The select trigger or detonation system includes a source and control device 36, an optical fiber F, one or more optical circulation couplers $C_1, C_2, \ldots, C_n$, and one or more light trigger or detonation means 20, 22, 24. The scope of the invention is not intended to be limited to any particular type of coupler, or any particular type of circulation coupler.

The optical fiber F has one or more fiber Bragg Gratings 30, 32, 34 for providing one or more fiber Bragg Grating optical trigger or detonation signals having wavelengths $\lambda_1, \lambda_2, \ldots, \lambda_n$. The source and control device 36 provides an optical signal on the fiber F that is transmitted through and reflected by the one or more fiber Bragg Gratings 30, 32, 34, for providing the one or more fiber Bragg Grating optical trigger or detonation signals. The fiber F can be terminated in a manner shown in FIG. 2, or returned to the source and control device 36 to monitor the fiber Bragg Grating frequency response changes due to temperature and pressure. Suitable adjustments may be made to the optical signal processing depending on the changes due to temperature and pressure. The source and control device 36 is very well known in the art; and the scope of the invention is not intended to be limited to any particular type or kind thereof.

The one or more optical couplers $C_1, C_2, \ldots, C_n$ each responds to the one or more fiber Bragg Grating optical trigger or detonation signals, for providing a respective coupled fiber Bragg Grating optical trigger or detonation signal to the one or more light trigger or detonation means 20, 22, 24. As shown, the one or more optical couplers include circulation couplers $C_1, C_2, \ldots, C_n$. A person skilled in the art would appreciate how the optic fiber Bragg Gratings 30, 32, 34 are used in combination with the circulation couplers $C_1, C_2, \ldots, C_n$ for providing the respective coupled fiber Bragg Grating optical trigger or detonation signal to the one or more light trigger or detonation devices. In operation, an optical signal is coupled through the circulation couplers $C_1, C_2, \ldots, C_n$, the optic fiber Bragg Gratings 30, 32, 34 reflects the respective coupled fiber Bragg Grating optical trigger or detonation signal having a respective trigger or detonation wavelength $\lambda_1, \lambda_2, \ldots, \lambda_n$ back through the circulation couplers $C_1, C_2, \ldots, C_n$ to the to the one or more light trigger or detonation devices. Circulation couplers $C_1, C_2, \ldots, C_n$ and fiber Bragg Gratings 30, 32, 34 are known in the art; and the scope of the invention is not intended to be limited to any particular type or kind thereof.

The one or more light trigger or detonation means 20, 22, 24, each responds to the respective coupled fiber Bragg Grating optical trigger or detonation signal, for triggering or detonating a respective device 40, 42, 44 such as an explosive charge of dynamite that needs to be detonated, or any other control device that needs to be triggered. The scope of the invention is not limited to the particular device to be triggered or detonated. For example, embodiments are envisioned in the construction or civil engineering industries; besides other control systems applications. The one or more light trigger or detonation means 20, 22, 24 are known in the art, and may include a detonation device that responds to the respective coupled fiber Bragg Grating trigger or detonation signal, for exploding dynamite disposed in a borehole of an oil well. The one or more light trigger or detonation means 20, 22, 24 may also include a photodetector with the necessary supporting electronics attached on an end of the optical fiber that responds to the respective coupled fiber Bragg Grating optical trigger or detonation signal, for providing a voltage signal for actuating a respective device. The one or more light trigger or detonation means 20, 22, 24 may also include a flashing compound, including nitro or nitroso-resorcinol, placed on an end of the optical fiber. The scope of the invention is not limited to the particular light trigger or detonation means.

The select trigger or detonation system 10 may include one or more fiber Bragg Gratings 50, 52, 54 having a very low reflectivity respectively placed next to the one or more light trigger or detonation means 20, 22, 24, for providing one or more fiber Bragg Grating signals that indicate whether the respective device 40, 42, 44 such as an explosive charge has been detonated and blown up.

The select trigger or detonation system 10 may also include one or more passband filters 60, 62, 64 each arranged between a respective one of the optical couplers $C_1, C_2, \ldots, C_n$ and a respective one of the light trigger or detonation means 20, 22, 24. Each passband filter 60, 62, 64 responds to the respective coupled fiber Bragg Grating optical trigger or detonation signal, for providing a respective passband filter fiber Bragg Grating optical trigger or detonation signal having a certain wavelength to prevent accidental detonation from stray reflected optical signals. As shown, the one or more passband filters 60, 62, 64 may also includes a Grating-based passband filter shown in FIG. 3 having one or more fiber Bragg Gratings with wavelengths $\lambda_1, \lambda_3, \lambda_4, \ldots, \lambda_n$for only passing an optical signal having one of the respective wavelengths such as $\lambda_2$. The one or more passband filters 60, 62, 64 may also include a coupler-based passband filter as described below in relation to the embodiment shown in FIG. 5. FIG. 3B shows a graph of a basic filter function of one of the n fiber Bragg Gratings with wavelengths $\lambda_1, \lambda_3, \lambda_4, \ldots, \lambda_n$ that functions as a stopband grating. In operation, optical light having a wavelength $\lambda_i$ is not transmitted through the fiber Bragg Grating having the wavelengths $\lambda_i$, while all other optical light having wavelengths other than the wavelength $\lambda_i$ is transmitted. FIG. 3C is a graph of a synthesized passband filter function using multiple Fiber Bragg gratings having wavelengths $\lambda_1, \lambda_3, \lambda_4, \ldots, \lambda_n$, which together form the passband filter shown in FIG. 3A. In operation, the passband filter in FIG. 3A is designed so that optical light having a wavelength $\lambda_2$ is transmitted (see FIG. 3C), while all other optical light having wavelengths other than the wavelength $\lambda_2$ are not transmitted. As a person skilled in the art would appreciate that the robustness of the passband filter in FIG. 3A is a function of the number of multiple Fiber Bragg gratings used to form the passband filter. The greater the number of Fiber Bragg gratings used to form the passband filter, the more robust the passband filter. The scope of the invention is not intended to be limited to any particular number of Fiber Bragg gratings used to form the passband filter.

Figure 4:
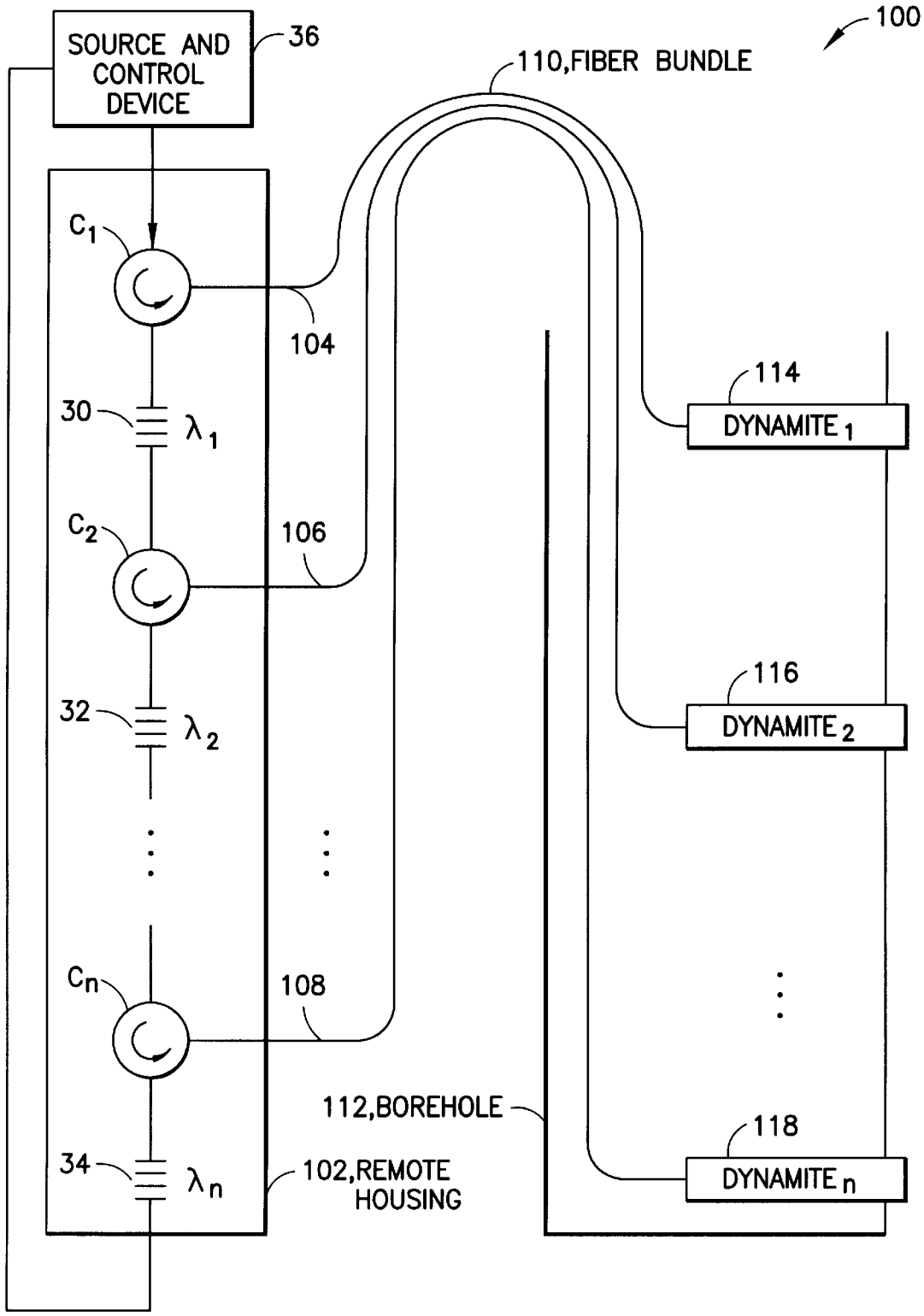
FIG. 4 is a schematic diagram of another embodiment of the present invention.

FIG. 4 shows another embodiment of the select trigger or detonation system generally indicated as 100. Elements in FIGS. 1 and 4 that have similar functions are similarly numbered. In FIG. 4, the circulation couplers $C_1, C_2, \ldots, C_n$ are arranged in a remote housing 102 away from the borehole and the harsh environment therein. In this embodiment, the optical fibers 104, 106, 108 are arranged in a bundle generally indicated as 110 and passed down into a borehole 112 to respective explosive charges such as dynamite 114, 116, 118.

Figure 5:
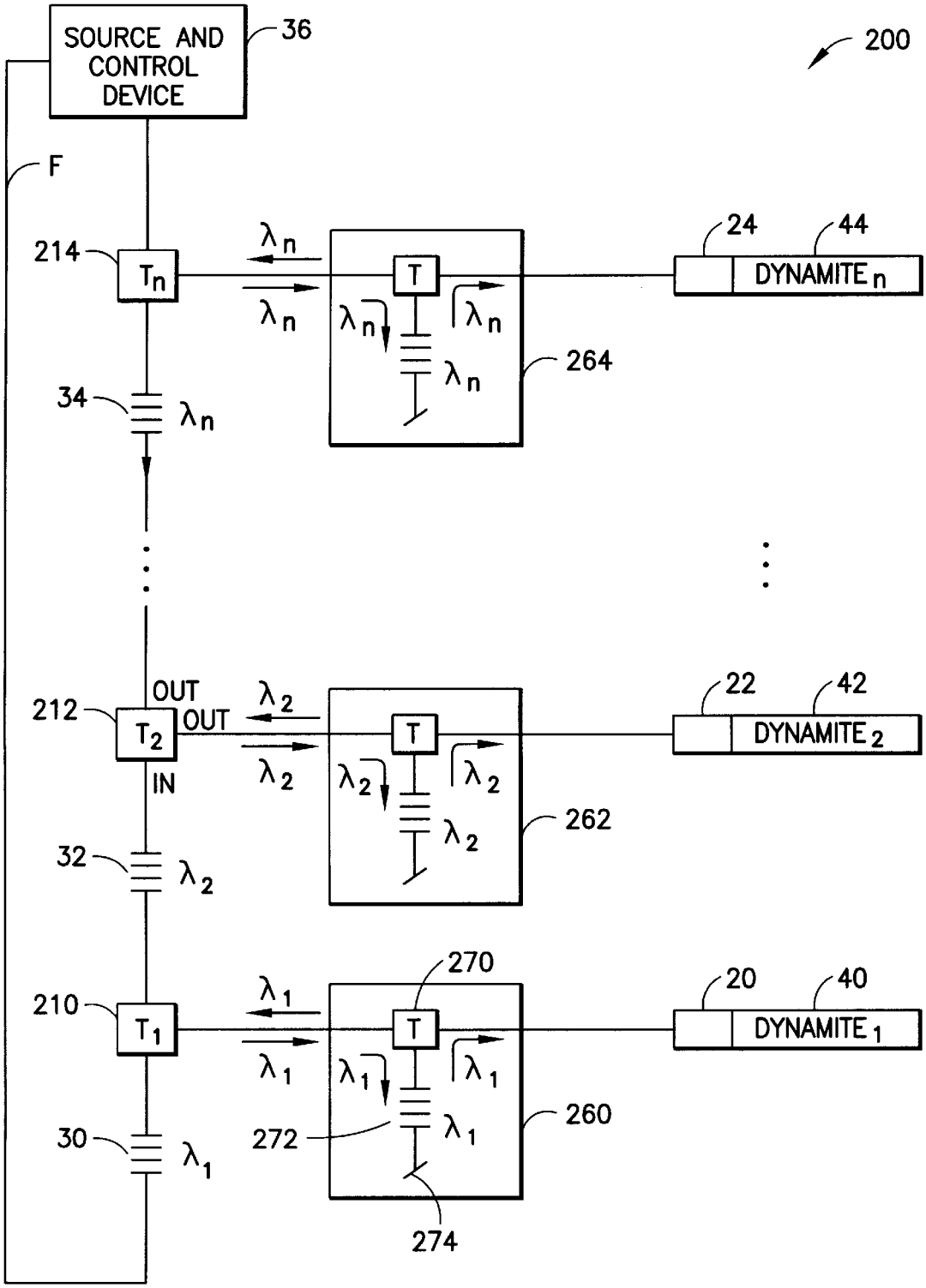
FIG. 5 is a schematic diagram of still another embodiment of the present invention.
Figures 6, 7:
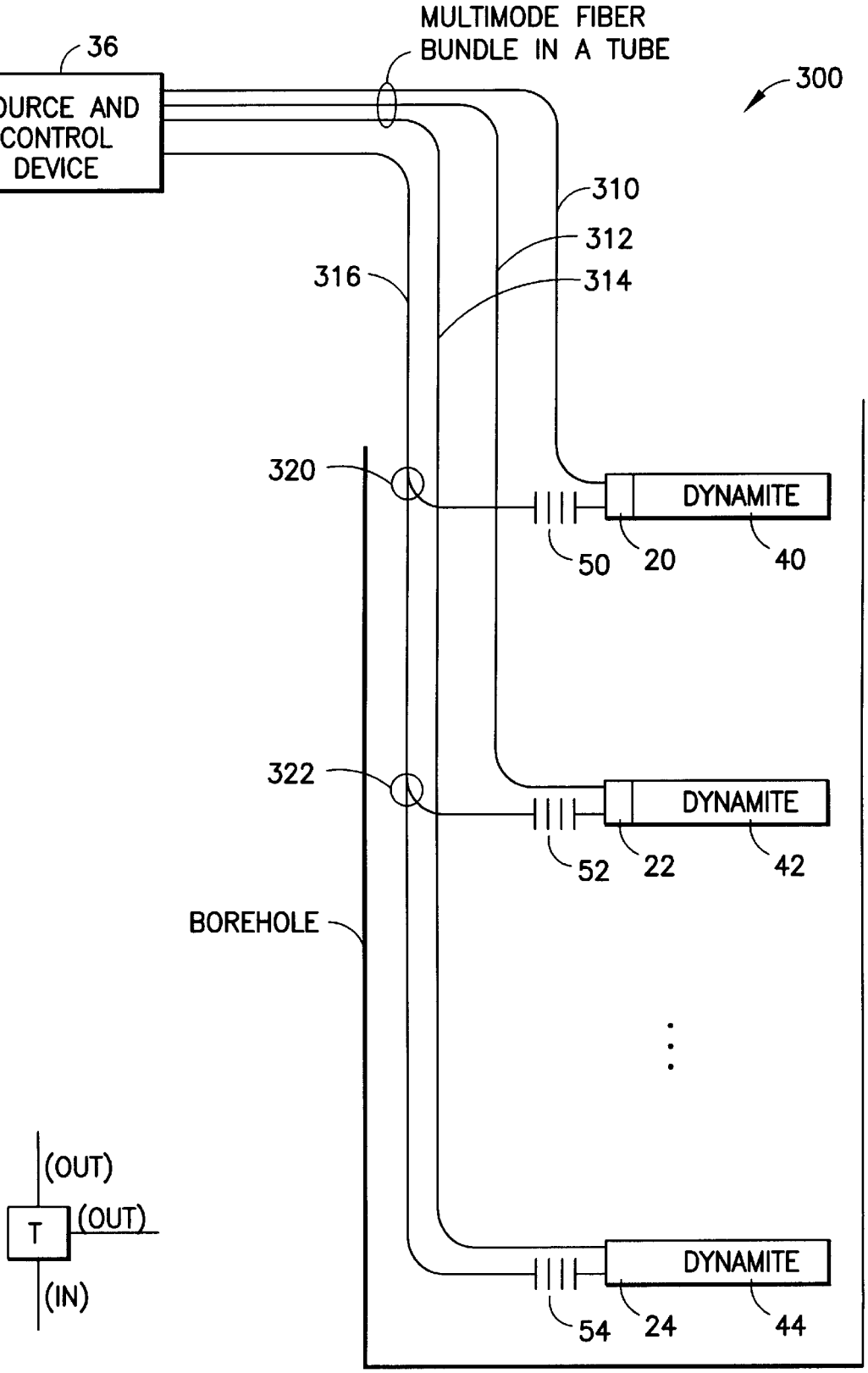
FIG. 6 is a schematic diagram of a T-coupler.
FIG. 7 is a schematic diagram of still another embodiment of the present invention using multimode fiber.

FIG. 5 shows another embodiment of the select trigger or detonation system generally indicated as 200. Elements in FIGS. 1 and 5 that have similar functions are similarly numbered. As shown, the select trigger or detonation system 200 has directional couplers 210, 212, 214. Directional couplers are known in the art; and the scope of the invention is not intended to be limited to any particular type or kind thereof. FIG. 6 shows a typical directional coupler also known as a T-coupler.

In FIG. 5, the select trigger or detonation system 200 has one or more passband filters 260, 262, 264. As shown, each passband filters 260, 262, 264 is a respective coupler-based passband filter having a directional coupler 270, a fiber Bragg Grating 272 with a wavelength such as $\lambda_1$, and a nonreflective termination generally indicated as 274, for only passing an optical signal having one of the respective wavelength such as $\lambda_1$.

FIG. 7 shows another embodiment of the select trigger or detonation system generally indicated as 300. Elements in FIGS. 1 and 7 that have similar functions are similarly numbered. As shown, the select trigger or detonation system 300 includes one or more multimode fibers for providing multimode optical trigger or detonation signals to deliver energy to the one or more light trigger or detonation means 20, 22, 24. The select trigger or detonation system 300 may also include one or more single mode fibers for providing one or more single mode optical trigger or detonation monitoring signal to monitor the one or more optical trigger or detonation means 20, 22, 24 using information from the fiber Bragg Gratings 50, 52, 54. The select trigger or detonation system 300 may also have couplers 220, 222.

Multiple Acoustic Sources Using Fiber Optics

FIG. 8 shows another embodiment of the select trigger or detonation system generally indicated as 400 for producing acoustic waves. Elements in FIGS. 1 and 8 that have similar functions are similarly numbered. The select trigger or detonation system 400 includes one or more photodetectors 410, 412, 414 and one or more transducers 420, 422, 424. In operation, each photodetector 410, 412, 414 responds to a respective fiber Bragg Grating optical acoustic source trigger signal from the light and source control device 36, for providing a respective electrical acoustic source signal to a respective transducer 420, 422, 424. Each respective transducer 420, 422, 424 responds to the respective electrical acoustic source trigger signal, for providing a respective acoustic wave.

In operation, a single strand of single-mode fiber is being used to drive multiple acoustic sources. FIG. 8 shows a design using three-way circulation couplers $C_1, C_2, \ldots, C_n$. Each circulation coupler $C_1, C_2, \ldots, C_n$ passes the light from one input almost entirely to the next port. Strongly reflective fiber Bragg Gratings 30, 32, 34 are used to selectively reflect light to power the photodetector 410, 412, 414. The light reflected from each fiber Bragg Grating is passed through a respective circulation coupler $C_1, C_2, \ldots, C_n$ to the fiber linked to a corresponding photodetector 410, 412, 414. Each photodetector 410, 412, 414 is activated by light of a respective wavelength $\lambda_i$.

In FIG. 8, light energy transmitted through the single mode fiber is used to directly drive the PZT transducer. The maximum power output is about 1 Watt that is the upper limit on how much light energy can be fed into a single mode fiber. In noisy logging environments, bigger acoustic sources may be required. The design in FIG. 8 could be modified so that the photodetector output is used to trigger the acoustic source. The reader is also referred to U.S. patent Ser. No. 08/933,544, filed Sep. 19, 1997, hereby incorporated by reference, for a discussion of the cooperation between a photodetector and a transducer.

Summary of the Basic Operation of the Invention

In summary, the present invention provides arrangements to detonate selectively multiple explosives in general, and more particularly to oil well perforation operations.

In FIG. 1, each fiber Bragg Grating 30, 32, 34 substantially reflects a narrow wavelength band. The bands are well separated. To detonate a particular explosive such as the explosive charge 42, the light within a narrow band centered at $\lambda_2$ is generated from the source and control device 36 and passed down the optical fiber F. The light is mostly reflected by the fiber Bragg Grating 32 of explosive charge 42 is guided to a light triggered detonator 22 through the circulation coupler $C_2$.

To verify that a targeted dynamite has indeed been fired, a fiber Bragg Grating 52 with very low reflectivity is placed next to the light triggered detonator 22. The reflected light is guided into the main optical fiber F and travels upward. The spectrum of the reflected light is monitored on the surface away from the borehole. The disappearance of the narrow-band peak in the spectrum indicates that the targeted dynamite has been fired and the fiber Bragg grating 52 has been blown off.

The pass-band filter 60, 62, 64 is placed in front of each dynamite to prevent accidental detonations. Or the circulation couplers $C_1, C_2, \ldots, C_n$ may be modified to prevent any of the light guided for detonation to be reflected back into the main optical fiber F.

A plurality of explosives can be detonated simultaneously by generating light containing the right bands and feed it into the optical fiber F.

In an oil well, there can be substantial variation in temperature from the top to the bottom. The wavelength of the reflective band of a grating section is a function of temperature and pressure. The wave bands can be monitored by generating a very low intensity light with broad bandwidth and feeding it into the fiber. The positions of the gaps in the spectrum of the transmitted light indicate the wavelengths of the bands.

FIG. 4 shows another arrangement where all the expensive parts are housed in the remote housing 102 on the surface away from the borehole 112. Fibers connected to all the dynamites are bundled together. In this arrangement, the monitoring of the band positions is not crucial as all the fiber Bragg grating sections are on surface and can be placed under a controlled environment.

FIG. 5 shows yet another arrangement where no expensive circulation couplers are used. The pass-band filters 260, 262, 264 are used to make sure that only the selected dynamite is triggered. This is necessary because the T coupler does not guide all the light reflected from the grating section to the fiber leading into the dynamite. Some of the reflected light comes up in the main fiber and may reach the dynamite above the targeted one if there is no pass-band filter placed in front of it. Even though the intensity of the light is only half of that reached targeted dynamite, there is no guarantee that it won't detonate the wrong dynamite. When all the fiber Bragg Gratings 30, 32, 34 are in the well, means of monitoring the grating characteristics would be required.

FIG. 7 shows a select trigger or detonation system generally indicated as 300 that uses separate fibers connected directly to a device for delivering optical trigger or detonation signals to the device to be triggered, including an explosive charge. The select trigger or detonation system 300 has one or more multi-mode fibers 310, 312, 314 are used to deliver the energy, and one or more single-mode fibers 316 are used to monitor the detonation. The multi-mode fibers 310, 312, 314 may be bundled together and linked to and controlled by the surface box individually.

The following three types of systems in order of complexity can be made using this invention.

Detonation Monitoring System

With some modification, the detonation monitoring mechanism can be made a stand-alone system and used with other non fiber-optic triggering systems. The select trigger or detonation system 100 shown in FIG. 1 can be made to perform the monitoring function. A piece of fiber with a fiber Bragg Grating is placed near or on the detonator or the explosive. Each fiber Bragg Grating has a unique periodicity. A broadband light is fed into the single-mode fiber F from the source and control box 36. The spectrum of the reflected light is analyzed. The absence of the reflected peak corresponding to a fiber Bragg Grating indicates that the fiber Bragg Grating has been blown away. The design can be changed so that light transmitted through the sensing gratings is analyzed.

If the number of detonators in the system is not large, T-couplers can be used in place of the expensive circulation couplers. The grating sections just below the couplers are not necessary. Or multiple fibers can be used to eliminate the need for couplers. There is a fiber line for each dynamite.

Select Trigger System

In oil well perforation and other operations, safety is paramount. To ensure safety, multiple trigger signals have to be positive to detonate an explosive. The present invention can be used to provide a trigger signal rather than to actually detonate the explosive. For example, a photodetector can be attached to the fiber as part of a light triggered detonation system. The electric energy stored in the photodetector is not used to directly detonate the explosive but to generate a voltage as one of the signals needed to trigger a detonator. Not very much energy is needed for this application.

The present invention can be integrated with other detonation systems. For example, the select trigger system can replace the Acoustic Tone system in Baker's Accufire system to provide a much more reliable, simpler, and cheaper trigger system.

The select trigger system can easily be made to include the monitoring system.

Select Detonation System

This system is very similar to the select trigger system described above except that the electric energy generated by the photodetector is used to detonate the dynamite directly. The photodetector is not necessary if a flashing composition is placed on the end of fiber. Such a construction is described in U.S. Pat. No. 4,391,195, hereby incorporated by reference. Nitro or nitroso-resorcinol can be activated with as little as 20–50 millijoules of received laser energy. Single-mode fibers can deliver this much energy in a fraction of a second.

For safety reasons, one might purposely design the detonation mechanism that requires much more energy than 20–50 millijoules. If one uses single-mode fibers, then longer times are needed for detonation. For faster operations, the system described in FIG. 7 is preferred.

Scope of the Invention

Although the invention has been described and illustrated with respect to exemplary embodiments thereof, the foregoing and various other additions and omissions may be made therein and thereto without departing from the spirit and scope of the present invention.

We claim:

1. A select trigger or detonation system using fiber optics, comprising:

an optical source for providing an optical signal having at least one triggering or detonation wavelength ($\lambda_1$, $\lambda_2$, . . . , $\lambda_n$);

an optical fiber having one or more fiber Bragg Gratings with one or more associated wavelengths ($\lambda_1$, $\lambda_2$, . . . , $\lambda_n$), the one or more fiber Bragg Gratings being responsive to the optical signal, for providing one or more fiber Bragg Grating optical trigger or detonation signals;

one or more optical couplers, each responsive to the one or more fiber Bragg Grating optical trigger or detonation signals, for providing a respective coupled fiber Bragg Grating optical trigger or detonation signal; and one or more light trigger or detonation means, each responsive to the respective coupled fiber Bragg Grating optical trigger or detonation signal, each selectively triggering or detonating when a respective triggering or detonation wavelength ($\lambda_1$, $\lambda_2$, . . . , $\lambda_n$) of the optical signal corresponds to a respective associated wavelength ($\lambda_1$, $\lambda_2$, . . . , $\lambda_n$) of the one or more fiber Bragg Gratings.

2. A select trigger or detonation system according to claim 1, wherein the one or more optical couplers include a respective circulation coupler.

3. A select trigger or detonation system according to claim 1, wherein the one or more optical couplers include a directional coupler.

4. A select trigger or detonation system according to claim 1, wherein the select trigger or detonation system further comprises one or more fiber Bragg Gratings having a very low reflectivity respectively placed next to the one or more light trigger or detonation means, for providing one or more fiber Bragg Grating signals that indicate whether a respective device such as an explosive charge has been detonated and blown up.

5. A select trigger or detonation system according to claim 1, wherein the select trigger or detonation system further comprises one or more passband filters each arranged between a respective optical coupler and a respective light trigger or detonation means, each passband filter being responsive to the respective coupled fiber Bragg Grating optical trigger or detonation signal, for providing a respective passband filter fiber Bragg Grating optical trigger or detonation signal having a certain wavelength.

6. A select trigger or detonation system according to claim 5, wherein the one or more passband filters includes a coupler-based passband filter having a directional coupler, one or more fiber Bragg Gratings having one or more respective wavelengths, and a nonreflective termination, for only passing an optical signal having the respective wavelength.

7. A select trigger or detonation system according to claim 5, wherein the one or more passband filters includes a Grating-based passband filter having one or more fiber Bragg Gratings having respective wavelengths for passing an optical signal having wavelengths that are not strongly reflected by any one of the fiber Bragg Gratings.

8. A select trigger or detonation system according to claim 1, wherein the one or more light trigger or detonation means includes a trigger device that responds to the respective coupled fiber Bragg Grating trigger or detonation signal, for triggering or detonating the respective device.

9. A select trigger or detonation system according to claim 1, wherein the one or more light trigger or detonation means includes a photodetector with the necessary supporting electronics attached on an end of the optical fiber.

10. A select trigger or detonation system according to claim 1, wherein the one or more light trigger or detonation means includes a photodetector with the necessary supporting electronics attached on an end of the optical fiber; and wherein the photodetector responds to the one or more fiber Bragg Grating optical trigger or detonation signals, for providing a voltage signal for triggering or detonating the respective device.

11. A select trigger or detonation system according to claim 1, wherein one or more light trigger or detonation means includes a flashing compound, including nitro or nitroso-resorcinol, placed on an end of the optical fiber.

12. An optical trigger or detonation system according to claim 1, wherein the one or more optical couplers are arranged in a remote housing.

13. An optical trigger or detonation system, comprising:

an optical source for providing an optical signal having at least one triggering or detonation wavelength ($\lambda_1$, $\lambda_2$, . . . , $\lambda_n$);

an optical fiber having one or more fiber Bragg Gratings with one or more associated wavelengths ($\lambda_1, \lambda_2, \ldots, \lambda_n$), the one or more fiber Bragg Gratings being responsive to the optical signal, for providing one or more fiber Bragg Grating optical trigger or detonation signals; and one or more optical couplers, each responsive to a respective fiber Bragg Grating optical trigger or detonation signals, depending on a respective optical trigger or detonation wavelength, for providing a respective coupled fiber Bragg Grating optical trigger or detonation signal containing information about selectively triggering or detonating a respective light trigger or detonation means when a respective triggering or detonation wavelength ($\lambda_1, \lambda_2, \ldots, \lambda_n$) of the optical signal corresponds to a respective associated wavelength ($\lambda_1, \lambda_2, \ldots, \lambda_n$) of the one or more fiber Bragg Gratings.

14. An optical trigger or detonation system according to claim 13, wherein the optical trigger or detonation system further comprises one or more light trigger or detonation devices, each responsive to a respective coupled fiber Bragg Grating optical trigger or detonation signal, for triggering or detonating a respective device.

15. An optical trigger or detonation system according to claim 13, wherein the one or more optical couplers includes a circulation coupler.

16. An optical trigger or detonation system according to claim 13, wherein the one or more optical couplers includes a directional coupler.

17. An optical trigger or detonation system to trigger or detonate selectively multiple explosives for oil well perforations, comprising:

an optical source 36 for providing an optical signal containing information about triggering or detonating respective devices;

an optical fiber F having one or more fiber Bragg Gratings, responsive to the optical signal, for providing one or more fiber Bragg Grating optical triggering signals having one or more trigger or detonation wavelengths $\lambda_1, \lambda_2, \ldots, \lambda_n$;

optical couplers $C_1, C_2, \ldots, C_n$, each associated with a respective fiber Bragg grating having a respective trigger or detonation wavelength $\lambda_1, \lambda_2, \ldots, \lambda_n$, each responsive to a respective fiber Bragg Grating optical trigger or detonation signal depending on the respective trigger or detonation wavelength $\lambda_1, \lambda_2, \ldots, \lambda_n$ of the respective fiber Bragg grating, for selectively providing a respective coupled fiber Bragg Grating optical trigger or detonation signal; and light trigger or detonation means, each associated with a respective optical coupler $C_1, C_2, \ldots, C_n$, each being responsive to the respective coupled fiber Bragg Grating optical trigger or detonation signal, for triggering or detonating one or more of the respective devices such as dynamite.

18. An optical trigger or detonation system, comprising:

a source and control device for generating one or more optical trigger or detonation signals containing information about triggering or detonating one or more respective devices;

one or more optical fibers for providing the one or more optical trigger or detonation signals; and one or more light trigger or detonation devices, each responsive to a respective one of the one or more optical trigger or detonation signals, for triggering or detonating a respective device;

wherein each optical fiber separately connects a respective light trigger or detonation device to the source and control device.

19. A select trigger or detonation system according to claim 18, wherein the one or more optical fibers includes one or more multimode fibers for providing one or more multimode optical triggering signals to deliver energy to the one or more light trigger or detonation devices.

20. A select trigger or detonation system according to claim 18, wherein the select trigger or detonation system includes one or more single mode fibers for providing one or more single mode optical monitoring signals to monitor the one or more light trigger or detonation devices.

21. A select trigger or detonation system according to claim 1, wherein the one or more light trigger or detonation means includes one or more photodetectors and one or more transducers;

wherein each photodetector responds to the respective coupled fiber Bragg Grating optical trigger or detonation signal that is an optical acoustic source trigger signal, for providing a respective electrical acoustic source signal; and wherein each respective transducer responds to the respective electrical acoustic source trigger signal, for providing a respective acoustic wave.

22. A select monitoring system using fiber optics, comprising:

an optical fiber having one or more fiber Bragg Gratings for providing one or more fiber Bragg Grating optical monitoring signals;

one or more optical couplers, each responsive to the one or more fiber Bragg Grating optical monitoring signals, for providing a respective coupled fiber Bragg Grating optical monitoring signal; and one or more fiber Bragg Gratings, responsive to the respective coupled fiber Bragg Grating optical monitoring signal, for providing one or more fiber Bragg Grating monitoring signals containing information for monitoring a respective device.

23. A select monitoring system using fiber optics according to claim 22, wherein the one or more fiber Bragg Gratings have a very low reflectivity respectively.

* * * * *